US005255436A

United States Patent [19]

Yoshida

[11] Patent Number: 5,255,436

[45] Date of Patent: Oct. 26, 1993

[54] KNIFE AND SHEATH ASSEMBLY

[76] Inventor: Kazuo Yoshida, Hikari-Cho, Seki-City, Gifu Pref, Japan

[21] Appl. No.: 985,327

[22] Filed: Dec. 4, 1992

[51] Int. Cl.[5] ..... B26B 29/02

[52] U.S. Cl. ..... 30/151; 274/232

[58] Field of Search ..... 30/162, 151; 224/232, 224/233, 234

[56] References Cited

U.S. PATENT DOCUMENTS 2,793,434 5/1957 Wigington ..... 30/151

3,524,570 8/1970 Seguine ..... 30/151 X 5,001,834 3/1991 Collins ..... 30/151

5,092,046 3/1992 Collins ..... 30/162

5,138,768 8/1992 Collins ..... 30/162

*Primary Examiner*—Douglas D. Watts

*Attorney, Agent, or Firm*—Bacon & Thomas

[57] ABSTRACT

Accidental dislodgment of a knife from its sheath is prevented by a pivotal tang having one end engageable with a recess in the knife handle and a second end for pressing by a user to release the first end, and a slidable latch for preventing unintentional actuation of the tang.

3 Claims, 2 Drawing Sheets

KNIFE AND SHEATH ASSEMBLY

BACKGROUND OF THE INVENTION

The invention relates to a gripping mechanism comprising a knife arranged in a casing.

In general a knife, commonly called a diver's knife, is accompanied with a sheath. When the knife lies in the sheath, it may be hung on waistbands. Such a sheath usually has a grasping device to keep the knife therein and preventing it from dislodging.

However, the grasping device of the prior art, when receiving an abrupt water pressure as the diver jumps into water with a knife hung on his waist or legs, frequently shifts from a holding state to a lossening state so that the knife drops out and sinks into water. Moreover, a sudden drop of the knife can cause accident injuries, resulting in danger to lives.

In view of these problems, the object of the invention is to provide a gripping mechanism that can firmly keep knives in sheaths without accidental dislodgement.

SUMMARY OF THE INVENTION

To obtain the above object, the invention provides a gripping mechanism comprised of a knife, a sheath accommodating the knife and able to be hung on belts, and a tang provided on the casing that can not only hold the knife in the casing but also release the knife when desired. The casing further having a latch movable between a position locking the tang to a holding state and a position releasing the tangs.

In accordance with the arrangement above-mentioned, moving the latch to the position locking the tang to a holding state while a knife is lying in the sheath will make the knife unable to be extracted. However, the latch at the release position will allow the knife to be taken out from the sheath.

An embodiment of the invention will be described hereinafter, by way of a non-limitative example, with reference to the drawings.

DETAILED DESCRIPTION OF THE PREFERRED EMBODIMENT

Figure 1:
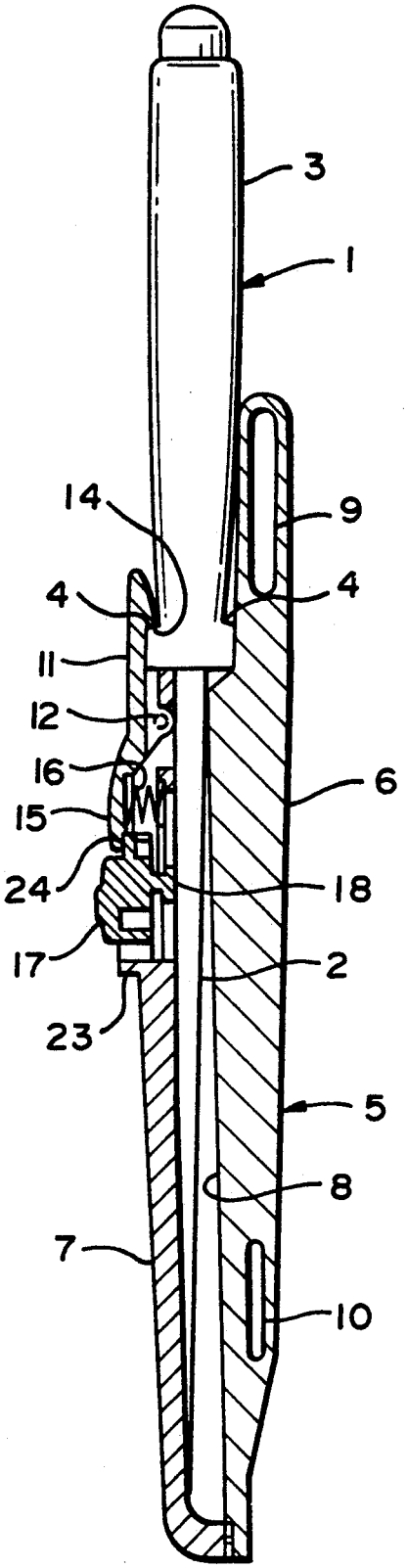
FIGS. 1 to 4 are the drawings illustrating the constitutions of a knife and a casing, wherein the knife is a diver's knife that consists of a knife blade and a handle with a pair of recesses on side surfaces thereof.
Figure 2:
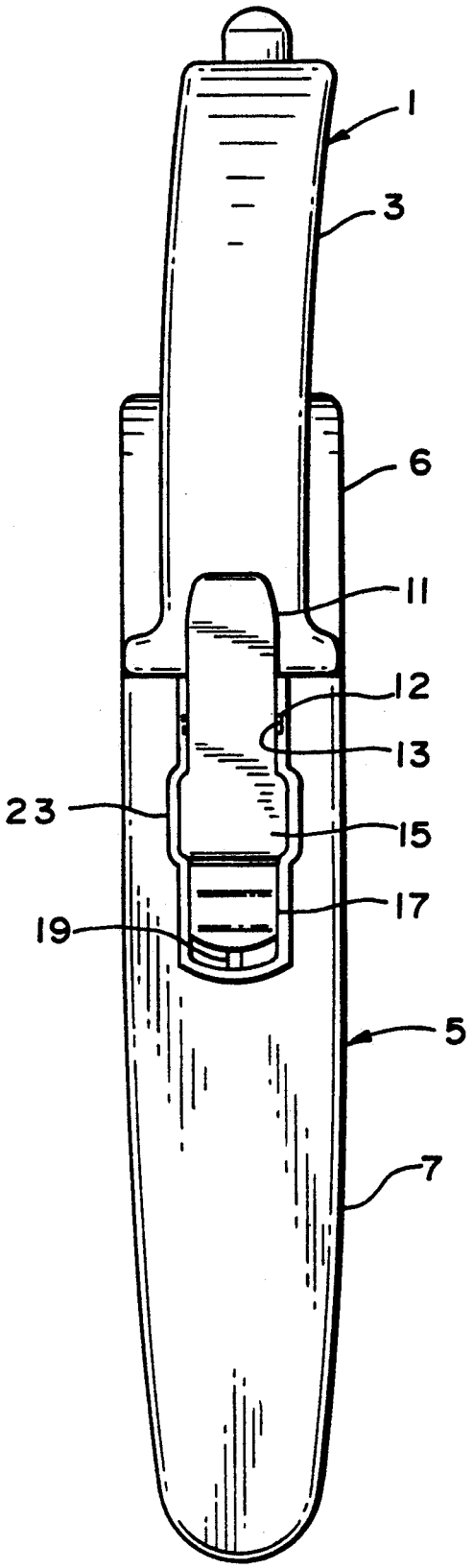

As indicated in FIGS. 1 and 2, a sheath 5 consists of a bottom casing member 6, a cover casing member 7, a tang 11, a latch 17, and a spring 16; the casing members 6 and 7 being hermetically sealed to form an accommodating volume 8, the bottom casing member 6 having elongated belt slots 9 and 10 through which the casing 5 can be tied by thin string to waistbands or feet of the user.

Figure 3:
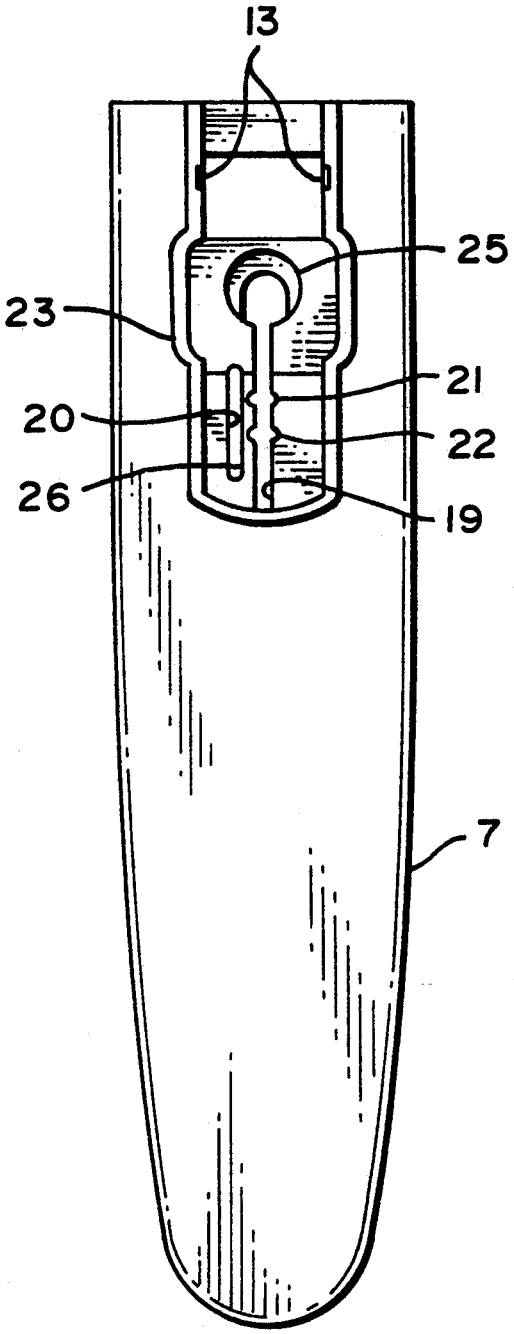

As best seen in FIG. 3, a guide frame 23 is formed on the outside wall of the cover casing member 7 and is integral therewith. On the inside wall of the guide frame 23 is provided a pair of support holes 13 bearing a stub axle 12 that pivotally mounts the tang 11 on the cover casing member 7. One end of the tang 11 has a raised lip 14 engageable with the recesses of the knife 1; the other end thereof has an actuating portion 15. Pressing the actuating portion 15 down and turning the tang 11 will result in the departure of the raised lip 14 of the tang 11 from the recesses 4 on opposite sides of handle 3 of the knife 1 and so releasing the holding state of the knife.

Inside the guide frame 23, a spring seat 25 is formed on the cover casing member 7 as shown in FIG. 3. A spring 16 is fitted in the volume enclosed by the spring seat 25 and the actuating portion 15, and constantly biases tending to rotate in the tang 11, urging the latter tending to rotate in outwardly from cover casing member 7 and thus compelling the raised lip 14 to engage within a recess.

Inside the guide frame 23 of the cover casing member 7 are a travel route slot 19 extending along the longitudinal direction thereof, an elongated slot 20 in parallel to the travel route slot 19, and a resilient portion 26 formed between the travel route slot 19 and the elongated slot 20. The semicircular notches 21, 22 acting as a detent means are located on the midway of the route slot 19. A latch 17 having a stepped portion 24 is arranged inside the guide frame 23 with a round projection 18 movably engaging with the travel route slot 19. The semicircular notches 21, 22 act as a detent mechanism to the movement of the round projection 18. In FIG. 1, the latch 17 lies on the notch 21 with the stepped portion 24 contacting with the bottom side of the actuating portion 15 and so the tang 11 is held in the holding state.

The diameter of the round projection 18 of the latch 17, slightly larger than the width of the travel route slot 19, is equal to that of the notches 21, 22 and thus as the latch 17 moves along the travel route slot 19, the round projection 18 squeezes into the route slot 19 against the elastic force of the resilient portion 26. With this arrangement, the round projection 18 shall be kept in the notches 21 or 22 when no external force is acted thereon. In accordance with the illustrative example of the invention, the notch 21 is the position that forces the tang 11 stay in the holding state and the notch 22 the position that allows the tang to be released from the holding state.

Now further consider in detail the action of the gripping mechanism of knives of the invention.

As is apparent from the foregoing description, under the state shown in FIG. 1, the raised lip 14 of the tang 11 is trapped by the recess 4 of the knife 1 and in the meantime the stepped portion 24 of the latch 17 abuts against the bottom side of the actuating portion 15 of the tang 1 to keep the tang 11 in a holding state and thus the knife 1 cannot drop out of the sheath 5 by accident.

Figure 4:
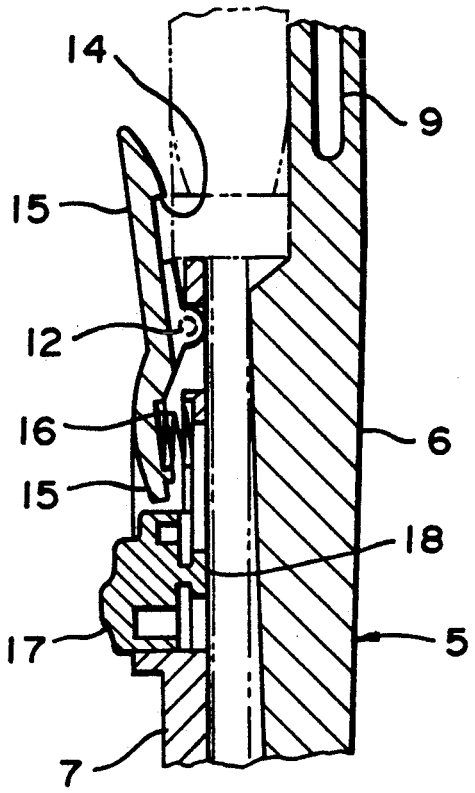

On the other hand, when it is desired to draw the knife 1 from the sheath 5, as best illustrated in FIG. 4, first move the latch 17 from the notch 21 to the notch 22 (in the down direction in FIG. 1) to disengage the stepped portion 24 of the latch 17 from the bottom side of the actuating portion 15 of the tang 11; in other words, releasing the locked state to allow the rotation of the tang 11, and then press down the actuating portion 15 of the tang 11 against the biasing force of the spring 16 to make the tang 11 pivot around the rotation center of the stub axle 12 so that the raised lip 14 of the tang 11 disengages from recess 4 of the knife, resulting in a state in which the knife can be taken out at will.

As described above, the gripping mechanism of a knife according to the invention has a tang to grasp the knife lying in the sheath or to loosen the grasping when desired. It further provides mounted on the casing a latch movable between the position of locking the tang to the grasping state and the position of releasing the tang. Consequently, when the knife is grasped by the tang, the capture can be insured by the latch to prevent the knife from dropping out accidentally and losing the knife in spite of the knife undergoing a sudden water pressure. Furthermore, because a firm locking of the knife is maintained, the dangers of accidentally dropping knives out of the sheath and possible injuries may be eliminated, which in turn increases safety.

It should be noted that the invention is not limited to the foregoing illustrative example. Applications to other types of knives, for example a fruit knife, will not be regarded as a departure from the spirit of the invention. All such modifications are intended to be included within the scope of the invention.

As has been described in detailed in the above, according to the present invention, the gripping mechanism can extirpate the problem of accidentally discharging the holding of knives and has excellent performance in securing knives in sheath.

I claim:

1. A knife and sheath assembly comprising:

a) a knife including a blade and a handle provided with at least one recess therein;

b) a sheath for receiving said blade, said sheath including a tang having a front end engageable within said recess for preventing withdrawal of said blade from said sheath and a second end engageable by a user for releasing said first end from said recess to permit withdrawal of said blade from said sheath, and a latch disposable between a first position for locking the front end within said recess and a second position for permitting release of said front end from said recess.

2. The knife and sheath assembly of claim 1 wherein:

a) said tang is pivotally mounted to said sheath and further includes means for biasing said front end into engagement within said recess; and b) said latch is slidable and further including detent means for maintaining the latch in either of the first or second positions.

3. The knife and sheath assembly of claim 2 wherein said means for biasing said tang includes a spring disposed between said second end of said tang and said sheath.

* * * * *